US006328597B1

(12) United States Patent
Epps

(10) Patent No.: US 6,328,597 B1
(45) Date of Patent: Dec. 11, 2001

(54) ELECTRICAL POWER AND DISABLING JACK

(76) Inventor: Oliver W. Epps, 2433 Winding Ridge Rd., Odenton, MD (US) 21113

( * ) Notice: Subject to any disclaimer, the term of this patent is extended or adjusted under 35 U.S.C. 154(b) by 0 days.

(21) Appl. No.: 09/599,590

(22) Filed: Jun. 22, 2000

Related U.S. Application Data

(60) Provisional application No. 60/194,687, filed on Apr. 5, 2000.

(51) Int. Cl.[7] ..... H01R 11/00

(52) U.S. Cl. ..... 439/502; 439/141

(58) Field of Search ..... 439/106, 135–138, 439/141–143, 501–502, 623, 369, 140

(56) References Cited

U.S. PATENT DOCUMENTS

| | | | | |
|---|---|---|---|---|
| 3,466,453 | * | 9/1969 | Greenberg | 307/10.1 |
| 3,663,924 | * | 5/1972 | Gerlat | 439/141 |
| 4,247,743 | | 1/1981 | Hinton et al. | 200/44 |
| 4,445,739 | * | 5/1984 | Wooten | 339/42 |
| 4,846,731 | | 7/1989 | Alwine | 439/651 |
| 5,193,665 | | 3/1993 | Jankow | 200/43.8 |
| 5,395,264 | * | 3/1995 | Keith | 439/502 |
| 5,462,452 | * | 10/1995 | Devine | 439/502 |
| 5,470,252 | * | 11/1995 | Fladung | 439/106 |
| 5,518,411 | * | 5/1996 | Belleci | 439/141 |
| 5,902,140 | | 5/1999 | Cheung et al. | 439/139 |
| 5,911,586 | | 6/1999 | Wintergerst | 439/133 |
| 6,012,941 | | 1/2000 | Burdenko et al. | 439/373 |

FOREIGN PATENT DOCUMENTS

| | | |
|---|---|---|
| 0 076 063 | 4/1983 | (EP) . |
| 0 495 149 A1 | 7/1992 | (EP) . |

* cited by examiner

*Primary Examiner*—Tho D. Ta
*Assistant Examiner*—James R. Harvey
(74) *Attorney, Agent, or Firm*—Richard C. Litman

(57) ABSTRACT

An electrical power cord disabling jack for preventing unauthorized use of an electrical appliance. The disabling jack may be provided in a kit and is a symmetrical device having an electrical cord with a male electrical plug at each end thereof. The electrical appliance is modified by removing a conventional male plug from the end of its cord, and installing a female receptacle in place of the male plug. The appliance may be activated by connecting the female receptacle of the appliance to one end of the disabling jack, and plugging the opposite end of the jack into a conventional female receptacle or outlet. A ground fault interrupter device may be installed inline between the two male plugs of the disabling jack as a safety feature. Alternatively, the jack may be provided with an automatically extending safety guard which covers the otherwise exposed electrical contacts of the jack when it is not plugged in to an outlet or other female receptacle.

6 Claims, 4 Drawing Sheets

ELECTRICAL POWER AND DISABLING JACK

CROSS-REFERENCE TO RELATED APPLICATION

This application claims the benefit of U.S. Provisional Patent Application Serial No. 60/194,687, filed Apr. 5, 2000.

BACKGROUND OF THE INVENTION

1. Field of the Invention

The present invention relates generally to electrical connectors and the like, and more specifically to an inline device and system for selectively disabling electrical appliances (stereos, computers, etc.) as desired. The present invention comprises a double male ended electrical connector, with the method of use comprising the removal of the conventional male end from the appliance cord and installation of a female end thereto. The present double male ended connector may then be used to provide electrical power to the appliance as desired, with removal of the device resulting in the inability to operate the electrical device due to the incompatibility of the modified power cord end. The present double ended connector may include various safety features as well, to obviate any electrical hazard therefrom.

2. Description of the Related Art

Many modern electrical and electronic appliances might be considered as a mixed blessing to many consumers and households. While it is true that they have provided many comforts and conveniences which were previously not attainable, they have also opened the door to misuse and less than desirable results. Examples of such are certain television programming, various computer websites, and stereo sound system misuse. While responsible parties in a household or other area may control the programs or output received from these devices, younger persons in the household may access programs or operate systems in ways which are not desired by responsible adults or parents in the household.

An example of such is the conventional stereo sound system. While most adults appreciate the wide variety of music and other audio programming which is available with such systems, younger persons often choose to listen to music or programming which the adults of the household find objectionable. Aside from the quality or content of the programming or music, the stereotypical young person is often seen by older persons as requiring entirely too high a volume level. While adults may be able to control the situation while they are at home, younger persons often abuse privileges when parents or guardians are away and turn up the sound volume to levels which result in objections by neighbors, particularly in apartments and other multiple family dwellings. Obviously, something must be done to curtail such misuse of appliances, and avoid continuous alienation of the neighbors.

Accordingly, a need will be seen for an electrical power cord disabling jack, for disabling the connection of an electrical power cord to an electrical outlet. The present disabling jack invention comprises a double ended male electrical connector, which serves as a link to provide electrical connection to a modified electrical power cord having the conventional male connector end removed therefrom, and a female or receptacle connector end installed thereto. The modified female connector end of the appliance cord cannot be connected directly to conventional female electrical outlet, without the present double ended jack being removably installed therebetween. The person controlling the present disabling jack need only remove the device from its inline installation between the modified electrical cord with its female connector and the conventional electrical outlet, to make it impossible to connect the electrical device to the outlet.

The present disabling jack preferably includes safety means for precluding any electrical shock hazard from the exposed male connector ends, in the event the device is left connected to a wall outlet but is unplugged from the female connector of the modified electrical appliance power cord. For example, a ground fault interrupter (GFI) device may be installed in series between the two male connectors of the device. Alternatively, at least one (and preferably both) ends of the disabling jack may be provided with an automatically extending guard to cover the male electrical connectors, when the device is not connected to a female electrical socket or outlet.

A discussion of the related art of which the present inventor is aware, and its differences and distinctions from the present invention, is provided below.

U.S. Pat. No. 4,247,743 issued on Jan. 27, 1981 to David O. Hinton et al., titled "Device For Preventing Unauthorized Usage Of Appliance," describes an electrical coupler having opposed male and female connectors. The female connector side includes a plastic cable tie type device which is specially configured for securing the male end of an appliance cord thereto. The body of the connector has an electrical cord extending therefrom, and terminates in a lock cylinder. The lock cylinder must be actuated by means of an appropriate key, in order to close the circuit for the "hot" line through the connector. Hinton et al. do not disclose any modification to the appliance cord connector, nor any provision for a symmetrical, double ended male electrical connector and safety means therefor, as provided by the present invention.

U.S. Pat. No. 4,846,731 issued on Jul. 11, 1989 to Kenneth T. Alwine, titled "Shielded Electrical Connectors," describes a connector link having opposed male components extending therefrom. The Alwine connector differs from the present invention, in that it is configured for connecting BNC and TNC type connectors as used in conducting radio frequency signals, rather than 115 volt ac cords and connectors. Accordingly, one of the protruding connectors of the Alwine device is not truly a male electrical contact, but has a female receptacle disposed within the protruding jack, for connecting electrically to a conventional BNC pin or the like.

U.S. Pat. No. 5,193,665 issued on Mar. 16, 1993 to Robert A. Jankow, titled "Electric Plug With Disabling Means," describes a male electrical connector or plug which is installed upon the end of an appliance cord or the like. The Jankow plug includes a lock cylinder therein which must be activated or deactivated using an appropriate key, in the manner of the device of the Hinton et al. '743 U.S. Patent discussed further above. While Jankow requires a conventional electrical cord to be modified by cutting off the conventional male plug and installing his lockable male plug, he does not provide for the installation of a female receptacle upon the end of the appliance cord and mating double ended male connector for use therewith, as provided by the present invention.

U.S. Pat. No. 5,902,140 issued on May 11, 1999 to Samuel Cheung et al., titled "Child-Safe Power Strip," describes various electrical connector embodiments, including single and multiple outlets for 115 volt ac household use.

The Cheung et al. 115 volt outlet comprises a female receptacle with a cover plate installed thereover including passages therethrough configured to accept the conventional three blades or pins of a male electrical plug. Means are provided for rotating the cover plate so that it is not in registry with the underlying receptacles. Connection is made by inserting the male plug contacts in the cover plate, rotating the plate so that it is in registry with the underlying receptacle, and completing insertion of the plug. Cheung et al. do not modify the conventional male plug end of the power cord or provide a double ended male adapter therefor, as provided by the present invention.

U.S. Pat. No. 5,911,586 issued on Jun. 15, 1999 to H. Peter Wintergerst, titled "System, Device And Method For Locking And Unlocking Power Flow To An Electrical Cord," describes a device or devices having two different means of controlling electrical power therethrough. In one embodiment, a hinged cover is provided over the female end of an extension cord, and may be locked in place to preclude connection of a male electrical plug thereto. In another embodiment, an inline key operated switch is provided. The two embodiments may be combined in a single device. The key actuated mechanism of the Wintergerst electrical cord more closely resembles the devices of the Hinton et al. '743 and Jankow '665 U.S. Patents discussed further above, than the present device. Wintergerst does not disclose the modification of an existing appliance cord to provide a female receptacle thereon, nor a double ended male connector for use therewith, as provided by the present invention.

U.S. Pat. No. 6,012,941 issued on Jan. 11, 2000 to Igor Burdenko et al., titled "Electric Cable Access Prevention Device," describes means for securing a removable electrical cord to a computer or like device accepting such a removable cord, and also describes an enclosure for removably securing about the male end of the cord to preclude its installation in an outlet. The Burdenko et al. lock box is more closely related to the locking mechanisms of the Hinton et al. '743, Jankow '665, and Wintergerst '586 U.S. Patents discussed further above, than to the present invention. Burdenko et al. do not disclose any modification of the male end of the cord nor a double ended male connector for use therewith.

European Patent Application No. 076,063 published on Apr. 6, 1983 to Raymond E. McIntyre, titled "An Electrical Connection Device," describes mating male and female connectors in which the male connector must be rotated or twisted slightly after engagement with the female connector, in order to make electrical contact between the two. The McIntyre connector set is not standard, at least in comparison to conventional 115 volt ac connectors used in the U.S.A., McIntyre does not disclose the modification of the male end of an appliance power cord to install a female receptacle thereon, nor any provision for a double ended male connector link for removable installation between a female ended electrical cord and a female electrical outlet, as provided by the present invention.

Finally, European Patent Publication No. 495,149 published on Jul. 22, 1992 to Dr. Alexander Schluttig et al. describes (according to the English abstract) an electrical safety socket in which the electrical circuit through the device is not completed until the plug is inserted completely into the socket. A series of microswitches or the like are provided to serve as the contacts. However, the European Patent Publication does not illustrate the modification of a conventional electrical power cord by removing its male plug and installing a female receptacle therefor, and provision of a double ended male connector for use with the modified appliance cord, as provided by the present invention.

None of the above inventions and patents, either singly or in combination, is seen to describe the instant invention as claimed.

SUMMARY OF THE INVENTION

Accordingly, it is a principal object of the invention to provide an improved electrical power cord disabling jack and modified power cord, for selectively disconnecting or disabling an electrical device to preclude unauthorized use thereof.

It is another object of the invention to provide an improved disabling jack comprising a short length of electrical cord having a male electrical connector or plug installed upon each end thereof.

It is a further object of the invention to provide an improved method for disabling an electrical appliance by providing a double ended male electrical connector and modifying the electrical cord for the appliance by removing the male electrical plug therefrom and installing a female receptacle in its place, thereby precluding direct connection of the appliance to a conventional outlet without use of the present disabling jack or adapter.

An additional object of the invention is to provide an improved disabling jack including safety means therewith, comprising a ground fault interrupter disposed inline therewith and/or retractable guard means for one or both ends of the device.

To meet the above objectives, the present invention provides an electrical power cord disabling jack, and a method of modifying an electrical cord for use with the present jack and for precluding direct connection of the modified cord with a conventional 115 volt AC electrical power outlet. The present jack essentially comprises a double ended male electrical connector, having fittings adapted for electrical connection to a conventional female electrical receptacle as found in a wall outlet or the like, and for connecting to a female receptacle in an electrical cord. The present jack is formed by installing two male connectors or plugs in a short length of electrical cord or line. The appliance cord is modified by removing the conventional male electrical connector and installing a female electrical receptacle in place.

Safety means may be provided with the jack, by means of a ground fault interrupter (GFI) inline between the two male plugs. Alternatively, or in addition, a retractable guard may be installed over one (or preferably both) plugs of the jack, to preclude contact with the electrical contacts thereof when the jack is plugged into an outlet without being connected to the modified electrical appliance cord; the guard automatically extends beyond the male contacts when the jack is not plugged in. The present disabling jack and modified power cord invention enables a person to control the operation of various electrical devices (e.g., stereos, computers, television sets, etc.) as desired, by removing the adapter jack when operation of the devices is not desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
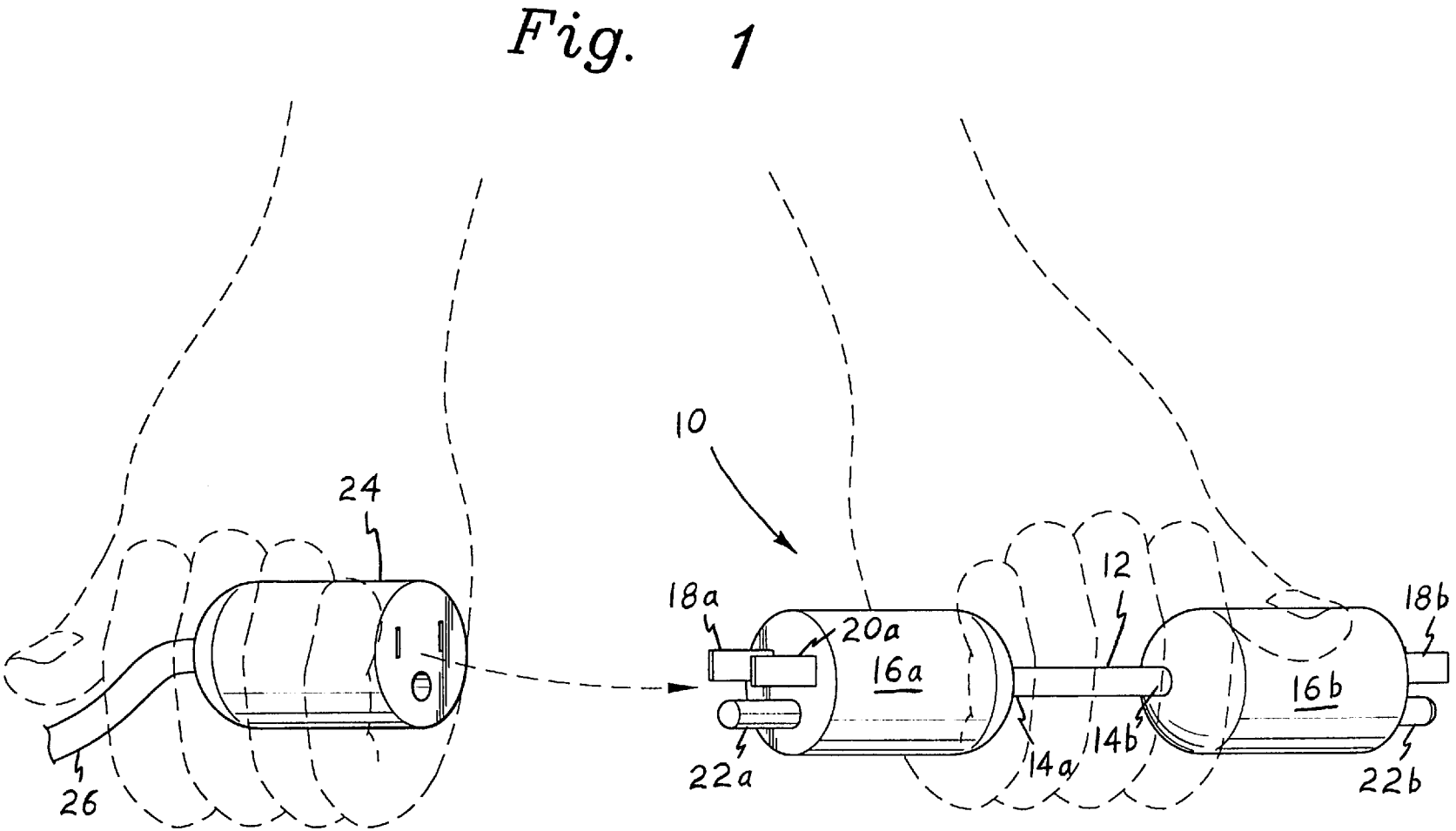
FIG. 1 is an environmental perspective view illustrating the connection of the present disabling jack with a modified appliance cord, in accordance with the present invention.

The present invention comprises an electrical power cord disabling jack or connector link, shown generally in FIG. 1 of the drawings and indicated by the reference numeral 10 throughout the drawing Figures. The present disabling jack 10 essentially comprises an electrical cord 12 (which may be of two or three wire configuration, as desired), with the cord 12 having opposite first and second ends, respectively 14*a* and 14*b*. The ends 14*a* and 14*b* are each provided with a male electrical plug, respectively 16*a* and 16*b*.

The two male electrical plugs 16*a* and 16*b* each include an electrically active blade, respectively 18*a* and 18*b*, and an electrically neutral blade; only the first neutral blade 20*a* is visible in FIG. 1, with it being understood that the disabling jack 10 with its two identical male connectors 16*a* and 16*b* is symmetrical and may be turned end to end to connect in a compatible receptacle(s) as desired. The present disabling jack 10 may be limited to a two wire connector having only the above described two blades extending from each plug, or may comprise a three wire connector including a ground prong, respectively 22*a* and 22*b*, extending from each plug 16*a* and 16*b*, as shown in FIG. 1.

The present double male ended disabling jack 10 provides connection to a conventional electrical receptacle (not shown) , and also simultaneously provides connection to a separate electrical receptacle or socket, as in the receptacle 24 shown installed to an appliance cord 26 in FIG. 1. Conventionally, appliance cords are equipped with distal male connectors or plugs, essentially like the two plugs 16*a* and 16*b* of the disabling jack 10. Thus, in order to connect either of the plugs 16*a* or 16*b* to the appliance cord 26, the appliance cord 26 must be modified by removing the conventional male plug and installing a female socket 24 thereto, as shown in FIG. 1. This permits the disabling jack 10 to be selectively connected between the appliance cord 26 and conventional wall outlet, and more importantly, disables the appliance without use of the disabling jack 10, as neither the cord 26 nor the conventional electrical outlet are equipped with mating connectors.

Figure 2:
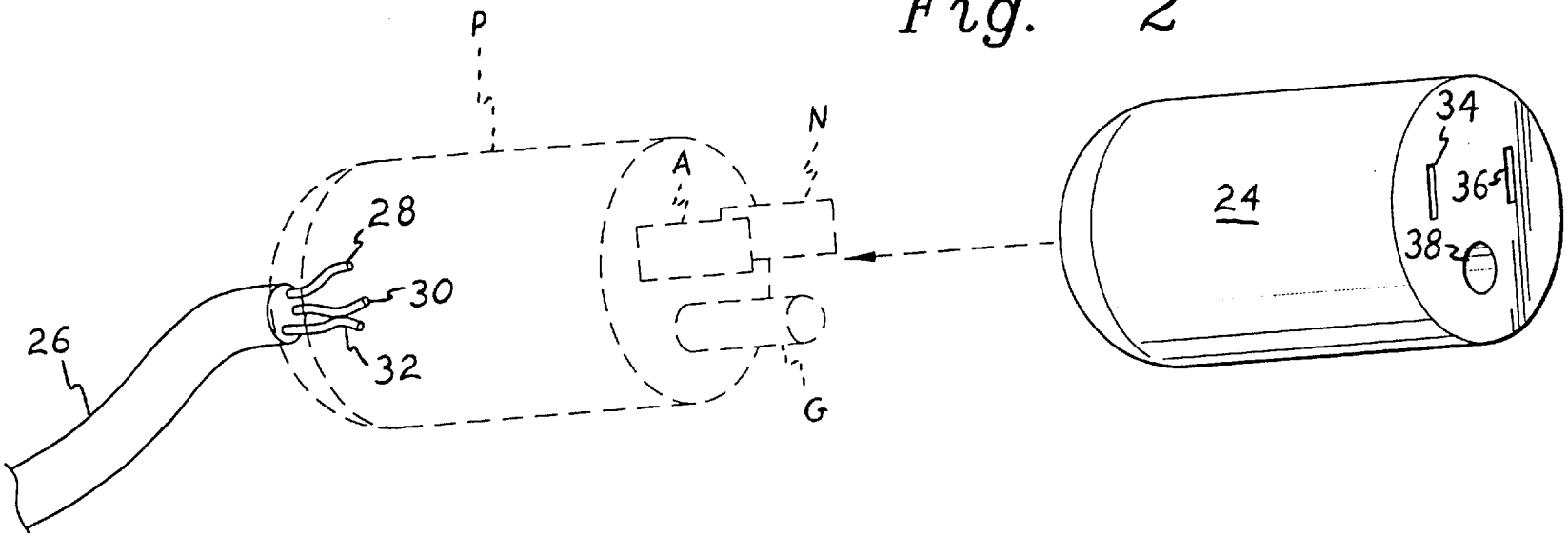
FIG. 2 is an exploded perspective view showing the removal of the conventional male plug or connector from an appliance cord, and the installation of a female receptacle therefor.

FIG. 2 illustrates the modification of an electric appliance cord 26 by removing the conventional male plug P therefrom, and installing a female socket or receptacle 24 end in place thereof. The appliance cord 26 illustrated in FIG. 2 includes an electrically active wire 28, an electrically neutral wire 30, and an electrical ground wire 32, which connect conventionally to the active and neutral blades A and N and ground prong G of the male plug P, as is known in the art. After removing the male plug P from the appliance cord 26, the three wires 28 through 32 are trimmed and readied for connection to a replacement female socket or receptacle 24. Such replacement sockets or receptacles 24 are conventional and readily available through hardware stores, etc.

Conventionally, such replacement sockets or receptacles 24 include a plurality of electrical contacts therein corresponding to the male electrical contacts, e.g., 18*a*, 18*b* through 22*a*, 22*b* of a male electrical plug 16*a*, 16*b*. The wires 28 through 32 are electrically connected internally within the socket 24 to communicate with the two slots 34 and 36, respectively accepting the active and neutral blades 18*a* (or *b*) and 20*a* (or *b*), and a hole 38 for the ground prong 22*a* (or *b*) of the male plug 16*a* (or *b*) of the present double ended disabling jack 10. While the above description is directed to the modification of a three wire appliance cord 26 including a ground wire 32, it will be seen that a two wire appliance cord lacking a ground wire is easily modified by using an appropriate replacement socket or receptacle for use with a two wire and two connector (at each end) disabling jack.

It must be noted that the present double male ended disabling jack 10 has the potential to produce some electrical hazard, if one of its two ends 16*a*, 16*b* is inserted into a conventional wall outlet and the opposite end 16*b*, 16*a* is left unconnected to expose the blades (at least the electrically active or "hot" blade 18*b*, 18*a*) extending therefrom. Accordingly, the present disabling jack 10 most preferably includes some form of safety means therewith to preclude electrical shock to persons who might contact the exposed plug (or at least the active blade 18*a*, 18*b*) when the opposite plug is installed in an electrically active outlet.

Figure 3:
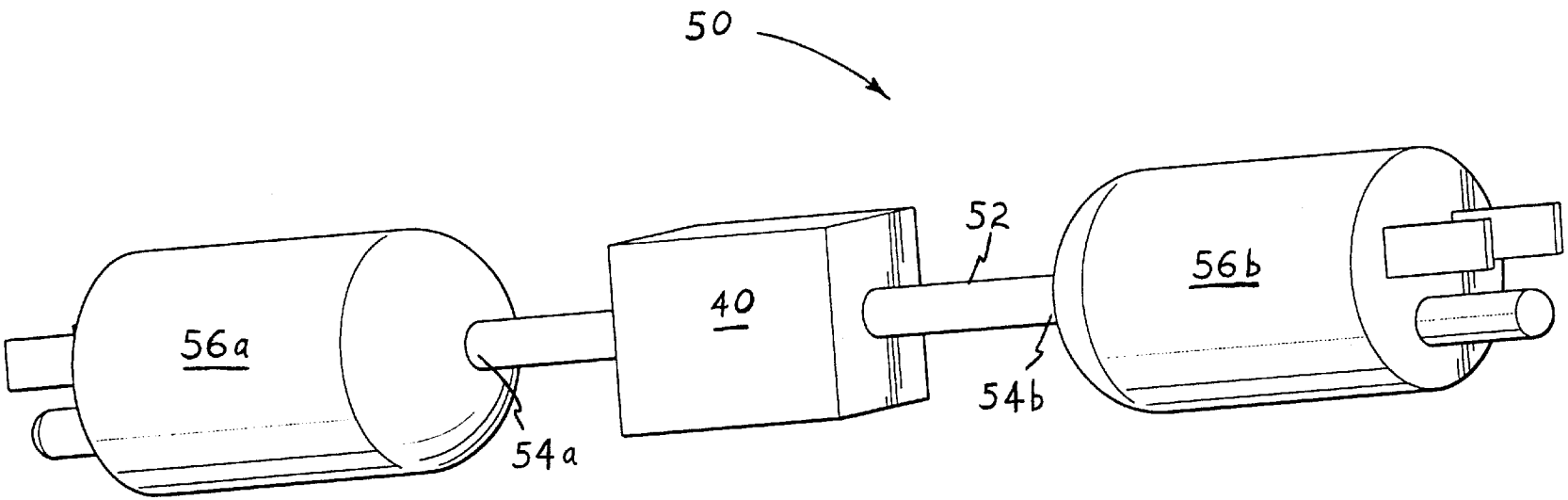
FIG. 3 is a perspective view of the disabling jack or adapter of the present invention, showing a conventional ground fault interrupter device inline therewith.

FIG. 3 illustrates one such means, comprising a conventional ground fault interrupter (GFI) 40 installed with a disabling jack 50. The GFI 40 is installed inline along the electrical cord 52, between the two ends 54*a* and 54*b* and their respective male electrical plugs 56*a* and 56*b*. Such GFI devices are well known, and detect any asymmetrical current flow from the electrically active wire which does not return through the neutral wire. When such an event occurs, the GFI immediately opens its internal circuitry to stop electrical power flow through the circuit in which it is installed, i.e., the disabling jack 50 of FIG. 3. Such GFI devices are easily installed in the disabling jack 50, by cutting the cord 52 at some point along its length (or installing it immediately adjacent one of the two plugs 56*a*, 56*b*) and connecting the appropriate wires to the input and output sides of the GFI.

Figure 4:
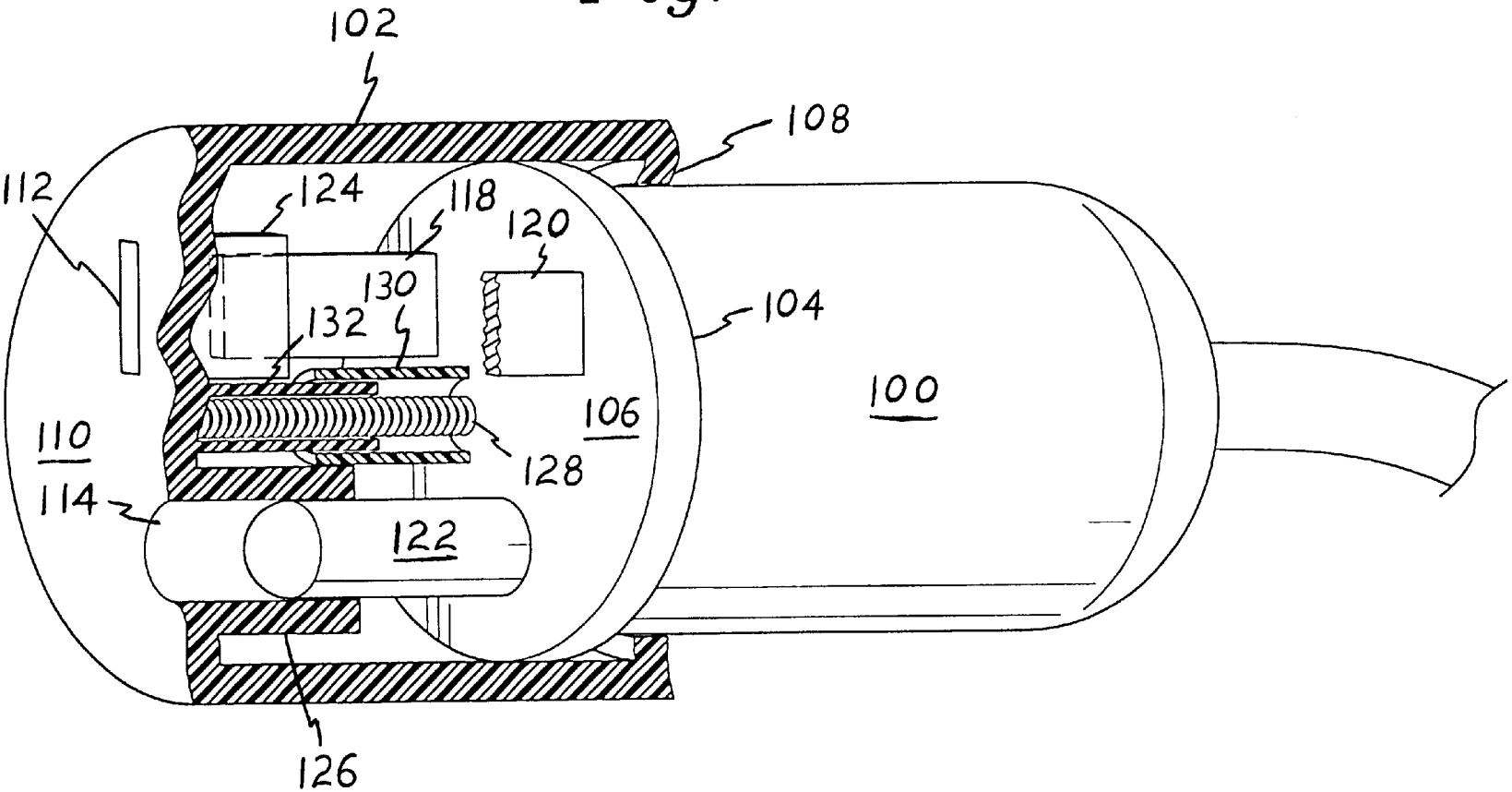
FIG. 4 is a broken away detailed perspective view of a male plug or connector including automatically extendible safety guard means therewith, for covering the electrical contacts of the plug when the plug is not connected to a receptacle.

FIG. 4 illustrates yet another safety means, comprising a mechanical cover which automatically extends to guard the otherwise exposed electrical contacts of the male plug. In FIG. 4, a male plug 100 is equipped with a cover or guard 102, which automatically extends to cover the electrical contact blades when the plug 102 is not electrically connected to an outlet or socket. Pressure on the end of the cover 102 causes it to retract automatically, exposing the electrical contact blades for insertion into a mating electrical power outlet.

The guard or cover 102 of FIG. 4 essentially comprises a shell which is configured to fit closely about the exterior shape of the plug 100. The plug 100 includes an outwardly extending flange 104 disposed about its electrical contact end 106 about which the interior wall of the cover shell fits, with the cover or guard 102 having an inwardly extending retaining flange 108 formed about the plug body contact end 110 thereof. The outer diameter of the plug flange 104 is larger than the inner diameter of the cover flange 108, thus precluding separation of the cover 102 from the plug 100. The cover 102 has a generally closed outlet contact end 110, with the exception of slots 112 (only one of which is shown in the broken away view of FIG. 4; it will be understood that the cover 102 is laterally symmetrical) and ground prong hole 114, respectively providing for the selective extension of the active and neutral blades 118 and 120 (the neutral blade 120 is partially broken away, for clarity in the drawing) and ground prong 122 of the plug 100 of FIG. 4, through the end 110 of the cover 102.

Each blade slot 112 includes an inwardly extending guide 124 (one of which is shown in FIG. 4, with it again being understood that the plug 100 and cover 102 assembly is laterally symmetrical) which extend along the two electrical contact blades 118 and 120. The guides 124 preclude axial rotation of the cover 102 relative to the axis of the plug 100, and assure that the blades 118 and 120 are always aligned with their respective slots 112. In a similar manner, the ground prong hole 114 has an inwardly extending guide or sleeve 126, serving the same purpose as the blade guides 124.

A compression spring 128 extends between the electrical contact end 106 of the plug 100 and the inner surface of the outlet contact end 110 of the cover or guard 102. The spring 128 serves to push the cover 102 outwardly from the contact face 106 of the plug 100, thereby concealing the electrical contact blades 118, 120 within their respective guides 124. The spring 128 is surrounded by a guide, comprising a cylindrical base component 130 affixed to and extending from the contact face 106 of the plug 100, and a mating extension component 132 affixed to and extending inwardly from the interior surface of the outlet contact end 110 of the cover 102. The two components 130 and 132 are concentrically disposed relative to one another, with one telescoping within the other to allow retractile and extensive movement of the cover 102 relative to the plug 100. The spring guide sleeves 130 and 132 preclude lateral bending of the spring 128, to ensure proper compressive force thereof and to preclude contact of the spring 128 with any electrically conductive elements of the plug 100.

The plug 100 with its guard 102 is easily used, by merely aligning the slots 112 and ground prong hole 114 (if so equipped) with the corresponding slots and hole of an electrical power outlet (alignment marks may be provided), and pushing the plug 100 toward the outlet to cause the guard or cover 102 to be pushed back over the body of the plug 100, thereby exposing the two electrical contact blades 118 and 120 and the ground prong 122 (if so equipped) , whereupon they enter the outlet passages and engage the corresponding electrical contacts therein. The spring 128 is selected to provide just sufficient compression to push the cover 102 outwardly over the electrical contacts 118, 120, and 122 of the plug 100, yet is not sufficiently strong to push the plug 100 from an outlet with which it is engaged. The normal clamping forces provided by the resilient internal contacts within the electrical outlet, capturing the respective electrical contacts 118 through 122 of the plug 100 therebetween, serve to hold the contacts 118 through 122 of the plug 100 securely within the outlet until such time as the plug 100 is positively withdrawn from the outlet.

In summary, the present electrical power cord disabling jack in its various embodiments provides a novel means of preventing unauthorized use of a household electrical appliance, such as a stereo, computer, television set, radio, etc., While the present disabling jack has been illustrated showing a relatively short length of cord extending between the two plugs, it will be seen that the cord is actually of indeterminate length and may be made in any length desired, or in fact may be completely eliminated.

While the present disabling jack may be provided as an essentially straight through electrical connection with the two or three conductors connected in series with their corresponding members at each end, preferably some safety means is provided to preclude any electrical shock hazard in the event the device is incorrectly used and is installed within an active electrical outlet without being connected to a corresponding female connector. Such safety means may comprise a conventional ground fault interrupter device installed inline between the two plugs, or may comprise some form of mechanical guard which automatically covers the otherwise exposed electrical contacts of the plug when the device is not in use, e.g., the device shown in FIG. 4 of the drawings. Where such mechanical safety means is provided, preferably both plugs of the device are provided with such.

While the present disabling jack has been described as a stand alone device, it will be seen that it may be provided as a kit or system including a replacement female connector for installation to the end of an appliance power cord, after removing the conventional male plug therefrom. Alternatively, the kit may include only a single male electrical plug along with a female connector, and means for electrically splicing the male plug removed from the appliance cord to the single male plug provided with the kit. The female connector supplied with the kit is then connected to the appliance cord end, essentially swapping the connectors to enable use of the present disabling jack as desired.

Accordingly, the present disabling jack in its various embodiments will be seen to provide a much needed means of controlling use of various appliances as desired. The present disabling jack and system including a correspondingly modified appliance power cord, precludes the complications of key operated mechanisms and other complex and costly devices, while still providing the desired function of controlling the appliance to which it is directed, as desired by the authorized person or operator of the appliance.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated.

It is to be understood that the present invention is not limited to the embodiments described above, but encompasses any and all embodiments within the scope of the following claims.

I claim:

1. A method for selectively disabling an electrical appliance, comprising the following steps:

(a) providing a first and a second male electrical plug, with each plug having a plurality of external electrical contacts extending therefrom;

(b) constructing a symmetrical disabling jack by electrically connecting the first and the second male electrical plug to one another so that their respective electrical contacts are generally opposed to one another;

(c) further providing at least one appliance cord having a distal electrical connector end;

(d) removing the conventional male electrical plug from the electrical connector end of the appliance cord;

(e) installing a female electrical receptacle to the electrical connector end of the at least one appliance cord, with the female electrical receptacle having a plurality of internal electrical contacts therein, configured for selective connection with the externally extending electrical contacts of a male electrical plug;

(f) selectively installing the disabling jack inline between the female electrical receptacle of the appliance cord and a female electrical power outlet for providing electrical power to an appliance; and (g) selectively removing the disabling jack from between the female electrical receptacle of the appliance cord and the female electrical outlet for disabling the appliance.

2. The method according to claim 1, wherein the step of constructing a disabling jack comprises:

(a) further providing an electrically active blade and an electrically neutral blade extending from each male electrical plug; and (b) further providing an electrically active and an electrically neutral contact within the female electrical receptacle.

3. The method according to claim 1, wherein the step of constructing an electrical disabling jack comprises:

(a) further providing an electrically active blade, an electrically neutral blade, and an electrical ground prong extending from each male electrical plug; and (b) further providing an electrically active contact, an electrically neutral contact, and an electrical ground contact within the female electrical receptacle.

4. The method according to claim 1, including the step of providing safety means for precluding electrical shock to persons contacting one male electrical plug when the other male electrical plug is electrically connected to an electrical power outlet.

5. The method according to claim 4, wherein the step of providing safety means comprises installing a ground fault interrupter inline between the first and the second male electrical plugs.

6. The method according to claim 4, wherein the step of providing safety means comprises:

(a) installing an automatically extending cover about at least one male electrical plug;

(b) providing means for automatically extending the cover to cover the externally extending electrical contacts when the male electrical plug is not connected to an electrical power outlet; and (c) providing further means for automatically retracting the cover for exposing the externally extending electrical contacts when the male electrical plug is connected to the electrical power outlet for making electrical contact therewith.

* * * * *